United States Patent [19]

Gravier et al.

[11] Patent Number: 4,597,376

[45] Date of Patent: Jul. 1, 1986

[54] HEAT RECOVERY HOOD

[76] Inventors: Maurice Gravier, 97 bis, rue de Belfort, 25000 Besancon; Denis Gravier, 25870 Auxon, Dessus; Jean-Claude Gravier, 5a, rue de la Pernotte, 25000 Besancon, all of France

[21] Appl. No.: 682,108

[22] Filed: Dec. 17, 1984

Related U.S. Application Data

[63] Continuation-in-part of Ser. No. 506,715, Jun. 23, 1983, abandoned.

[30] Foreign Application Priority Data

Jun. 22, 1982 [FR] France ..... 82 11040

[51] Int. Cl.[4] ..... F24B 7/00

[52] U.S. Cl. ..... 126/121; 126/400; 126/131; 237/52; 237/55

[58] Field of Search ..... 126/120, 121, 123, 126, 126/130, 132, 60-66, 99 P, 108, 112; 237/51-55; 165/DIG. 12, 104.11 A

[56] References Cited

U.S. PATENT DOCUMENTS

| | | | |
|---|---|---|---|
| 859,616 | 7/1907 | Repetto | 237/55 |
| 4,270,512 | 6/1981 | Van Der Maas | 126/121 |
| 4,461,272 | 7/1984 | Larsson et al. | 126/75 |
| 4,478,208 | 10/1984 | Pitha | 126/120 |

FOREIGN PATENT DOCUMENTS

| | | | |
|---|---|---|---|
| 614033 | 10/1979 | Switzerland | 126/132 |
| 732992 | 7/1955 | United Kingdom | 126/132 |
| 2076955 | 12/1981 | United Kingdom | 237/55 |

*Primary Examiner*—James C. Yeung
*Attorney, Agent, or Firm*—Erwin S. Teltscher

[57] ABSTRACT

A fireplace hood made as a massive solid structure defining the top of the firebox of the fireplace. The solid structure absorbs, stores the heat and radiates it when the fireplace is not in use. The massive structure is preferably made monolithic of a poured refractory material with internal hot gas flues open to a surface of the structure and in communication with the firebox for receiving hot gases. The hot gas flues open to a hot gas accumulator in communication with a tubular member for connection to the fireplace chimney. The fireplace has a convection tube system in its walls for heating cold air from the room in which the fireplace is disposed.

4 Claims, 7 Drawing Figures

HEAT RECOVERY HOOD

This is a continuation-in-part application of our application No. 506,715 filed June 23, 1983, now abandoned.

BACKGROUND OF THE INVENTION

The present invention relates to a heat-recovery hood for fireplaces, open hearths and the like and to a fireplace using such a hood.

Heat-recovery devices allowing the recovery of heat from open and closed fireplace chimneys are known. These known devices are disposed in the flow path of the exhaust smoke and gases. These devices make use of shape and thermal exchange areas such as different shapes of tubes. The heat exchange areas are varying shapes and have these tubes disposed at different areas. The tube positions take into consideration safety.

However, the performance and efficiency of these devices remains poor and the heat recovery is not maximized and its distribution is not uniform.

SUMMARY OF THE INVENTION

The present invention is a hood which overcomes the indadequacies of the known hoods, heat-recovery and heat-storing devices for fireplaces and the like.

The device, according to the invention, is a hood replacing the known hoods associated with a fireplace and the heat exchange tubes thereof.

A feature of the present invention is that heat-exchange passages are both cast or formed as flues in a solid structure of a material which functions as a heat-absorber and storage so that the hood is a heat-accumulator. The flues are disposed internally of the hood and function as hot gas flues. The heat-accumulating material is a mass of a large volume which allows a better regularity and uniformity of heating since it stores heats and radiates it later when the device is not in use.

The heat-accumulating material may be of any known kind compatible with the hood. For instance, the material can be a refractory concrete or other heat-retaining material employing a binder to form a mass and it can also be a composite material.

The device, according to the invention, is in the form of a hood which has a solid structure having tubes or flues internally part thereof arranged vertically or tilted relative to the horizontal and vertically converging towards the center of the hood. The heat-accumulating material is disposed about the tubes which define flues.

The method of construction of the invention provide for defining heat-exchange passages or flues without the use of tubes. The heat-exchange passages may be formed in the heat-accumulating material at the time of its pouring, and after the material has set the hot gaz passages are permanently formed.

The heat accumulator of the device, made for example, of a refractory mass, is heated by passage of hot smoke and hot exhaust gases interiorily of the heat-exchange passages or tubes. An extensive well distributed heat-accumulating area and volume is achieved through this structure. As many heat-exchange tubes or flues as desired can be arranged therein.

Another feature of the present invention is that after the hearth of fireplace has been used and then is not in use, the accumulated heat stored in the heat-accumulator is given off by radiation or may be forcibly extracted by the use of a blower or turbine or the like.

The discharge of the accumulated heat from the heat-accumulator may be accomplished by the use of the upper openings in a warm air accumulator of a vast number of vertical ducts passing through the refractory material in the heat accumulator and being secured to the vertical wall of the fire box and which can be connected exteriorily of the heat recovery device or apparatus. The air accumulation and distributor is the upper part of the apparatus.

Still another feature of the present invention is the provision of two circuits within the hood. A first circuit is provided by the heat-exchange tubes or hot gas passages through which the hot smoke and hot exhaust gases pass and these are connected to a smoke collector which itself communicates with the chimney of the hearth through a accumulator and collector shapes as a box. A second circuit is formed by ducts in which a fluid, for example air, flows to be heated by heat transfert thereto by the heat accumulated. This second circuit communicates with a warm air collector and accumulator exteriorily to the working network. On the upper part of the apparatus, the secondary heat-transfer medium such as air, flows through the ducts by means of natural convection. These ducts are secured by one of their face directly to the lateral vertical side walls of the fire box in order to obtain direct transmission of heat to their inside empty volume and have convection flow.

The heat recuperator or heat recovery device of the invention is arranged, for example, over a hearth firebox with a large area and volume of refractory material such as a refractory concrete. It may be used on a closed hearth or fireplace for example. The hearth is provided under its bottom with peripheral ducts for cold air flow to flow therethrough by natural convection which allows a first recovery of heat along the refractory laterial walls of the firebox before the air arrives at the level of the device according to the invention.

The device, according to the invention, can also be combined with a closed hearth or fireplace in which the metal hood usually therein is provided or replaced by the hood of the present invention with refractory material as disclosed. The device can readily be positioned in the upper part of the fireplace forming the upper part of the firebox of the fireplace.

Still another feature of the present invention is that the device provides excellent heat distribution in the refractory accumulator material which is provided with the heat-exchange flues or passages. Good heat accumulation regulation is obtained and the hearth of fireplace is improved by the massive refractory material that is heated. The construction of the device is such that maintenance and brushing interiorily of the heat-exchange tubes or passages is possible and can readily be accomplished.

Heat is coming faster in the room due to the convection ducts placed on and in contact with the lateral walls of the firebox.

In application on a closed hearth of fireplace, perfect or substantially improved combustion is obtained. The smoke is drawn up through the heat-exchange flues or passages and the massive refractory material radiates heat into the room within which the fireplace is provided.

The efficiency of the hearth or fireplace is improved in that a great saving of combustible material consumed therein is obtained. The usual unburned gasses of wood are completely burned. Flames can be seen in the flues. The device is very reliable and has no complex mechanical parts or special piping, and accordingly, is less subject to any damage.

IN THE DRAWINGS

The invention can be better understood in conjunction with the following description and appended drawings and claims in which:

DESCRIPTION OF A PREFERRED EMBODIMENT

Figure 1:
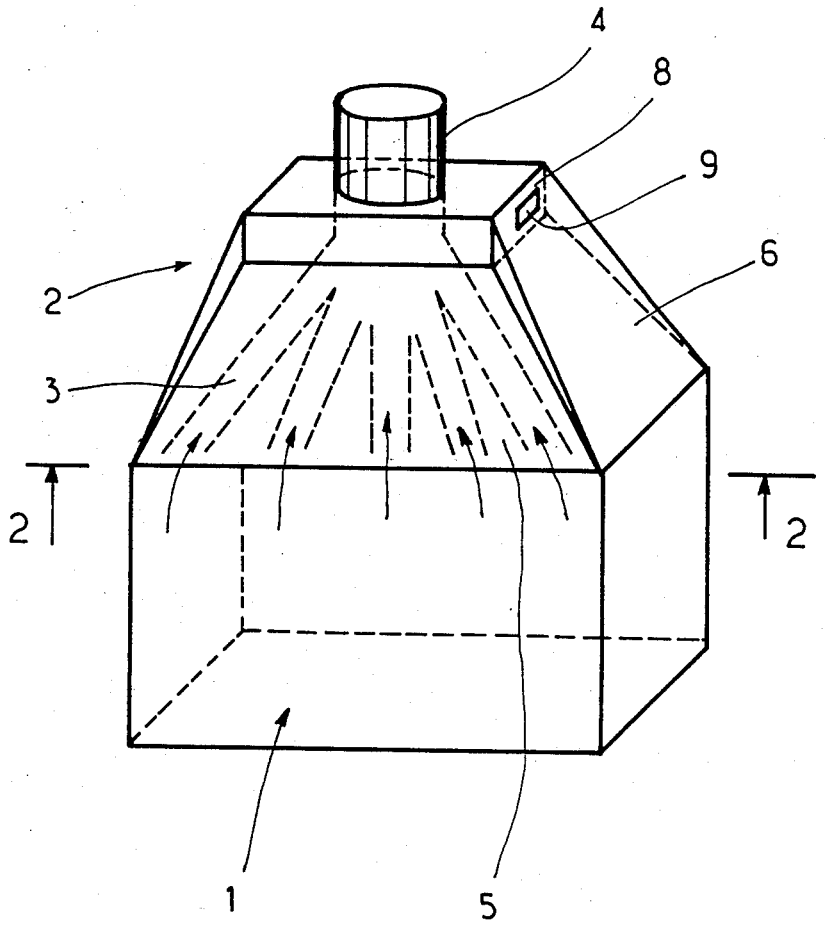
FIG. 1 is a schematic perspective view of a cutaway of an open hearth chimney fitted with a heat recuperator according to the invention.

As shown in FIG. 1, an open or closed hearth firebox 1 is provided with a heat-recovery device generally designed 2, according to the invention, in the form of a hood. The device comprises heat-exchange tubes or hot gas flues 3 which are disposed vertically and tilted with respect to the horizontal or vertical and disposed converging to a smoke collector 4 which is tubular shape and with which the tubes 3 communicate directly, or through an intermediate collecting chamber formed below the tubular member 4. The heat-exchange tubes 3 are preferably distributed, for example, in sets, in the whole volume of the device 2.

The heat-exchanger flues are tubes made of metal or are formed as passage-ways built into a volume of refractory material 5 which is, for example, a monolithic refractory concrete. The heat-exchang tubes 3 are of metal integral with the box 6 of the recuperator device 2 or as indicated heretofore, formed upon pouring of the refractory material in which case the passages or flues 3 are formed during the pouring and setting of the refractory. These passages or flues may be formed by the use of expanded polystyrene or any other similar material able to be removed after hardening of the refractory concrete.

The forms used for forming the passages may even be left in place if desired and these are consumed after the use of the apparatus, usually with the first fire built in the fireplace in which the device is being used. The heat-exchange passages are accordingly cleared and function as hot gas flues. It is only necessary that at least one of the passages is clear before starting a fire so that there is initial sufficient draft.

This method of construction is the simpliest method for making of a device according to the invention in accordance with the process of manufacturer disclosed.

Figure 2:
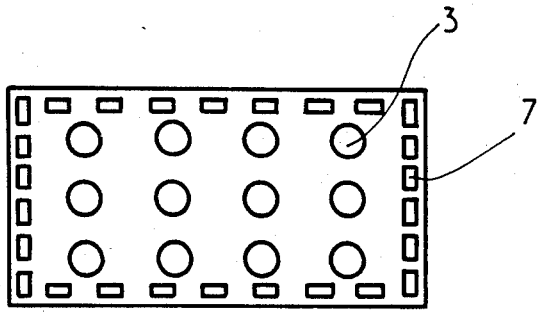
FIG. 2 is a section view taken along section line II—II of FIG. 1.

The heat accumulated in the large refractory mass 5 is extracted by fluid circulation, preferably ambient air flowing through by natural convection. The air passes through the refractory 5 receiving accumulated heat as it passes through ducts 7 arranged grouped as shown in FIG. 2 and having a rectangular cross section. The tubes are shown having a circular cross section. It is clear that the heat-exchange tubes 3 can have a desired cross section and even different cross section dimensions within each of the two groups of heat-exchange passages.

The heat exchange ducts 7 shown in FIG. 2 are rectangular and preferably used in the whole periphery of the refractory mass and converge at their upper end to a warm air, heat-recovery collector 8 connected to a working circuit, such as distribution ducts, not shown by an opening 9. It is to be understood that the smoke collector 4 passes through the warm air collector 8 without communicating with it.

According to the method of construction of the present invention, the refractory mass can be formed by use of stackable prefabricated components, such a refractory blocks. However, the poured mass technique is preferred. The heat recovery mass can be poured at the site and forms of monolithic or unitary structure that is the top of the firebox of the hearth.

Figure 3:
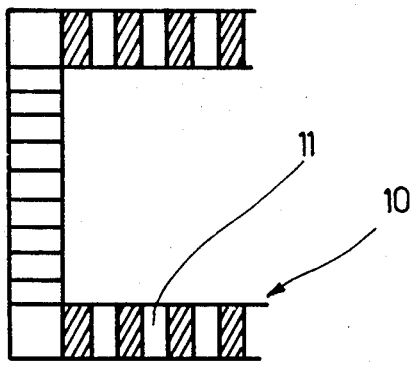
FIG. 3 is a fragmentary section view of a closed hearth fitted with a heat recuperator and accumulator in accordance with the invention.
Figure 4:
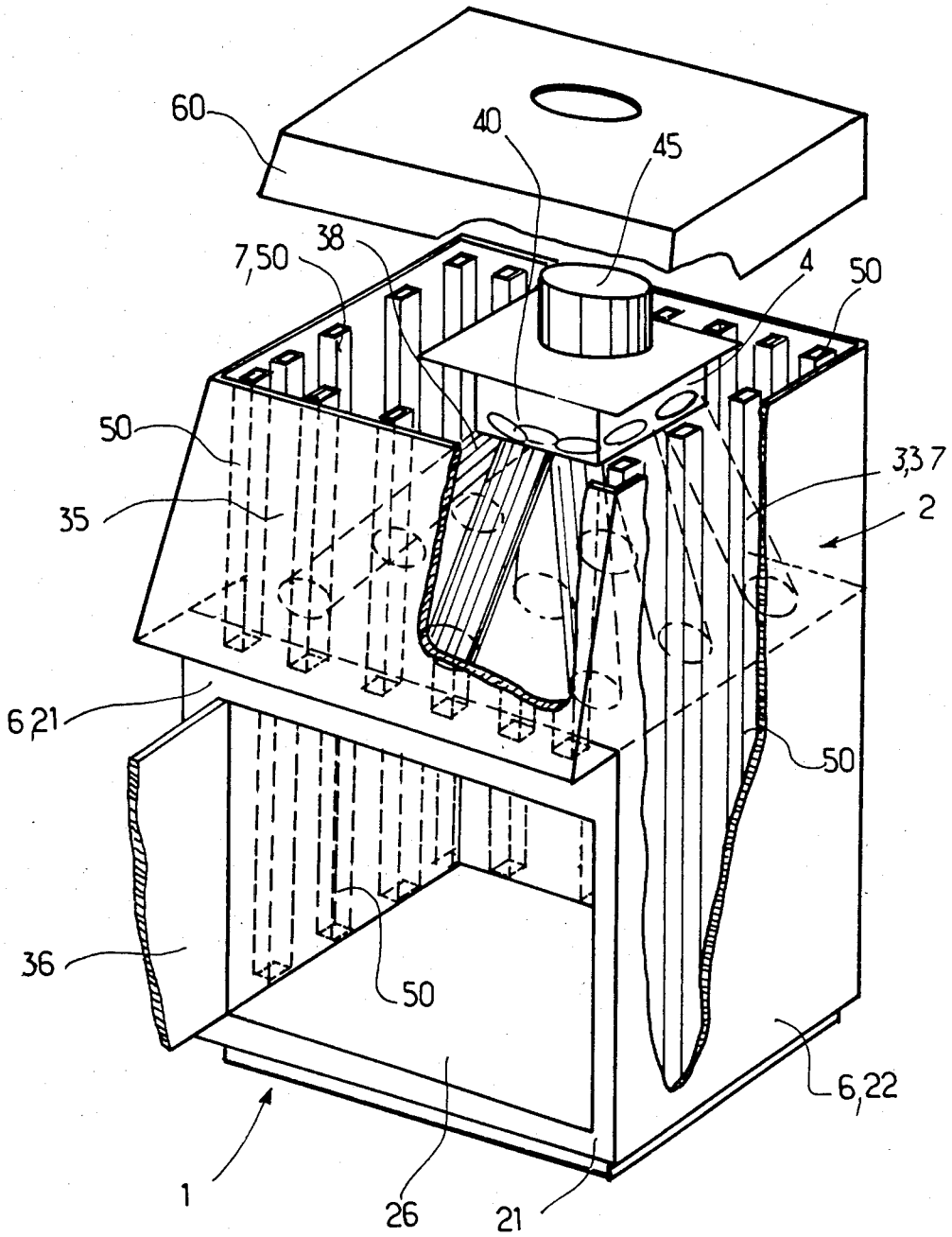
FIG. 4 is a perspective view of a preferred embodiment of a complete fireplace provided with a recovery hood according to the invention.

The air flow around a closed hearth can be carried out by means of use of a castellation 10 on the sidewalls of the hearth such as shown in FIG. 3. Hollow tubes 11 of this castellation are connected directed to the air flow tubes or ducts 7. The tubes 11 open at the lower end. The spaces between tubes 11 are filled with refractory concrete or other material.

In case of an open hearth, the air feed to the hearth is performed in the usual manner. In the case of a closed hearth, the air feed is realized by a well known method, through a central opening situated at the base of the device contiguous with the firebox and able to distribute the combustion air on the whole surface.

Advantageously, the device is provided registers or other types of regulators which regulate the flow of the hot smoke and gases increasing the time of flow through the heat-exchange tubes or passages so that the heat exchange is improved.

Those skilled in the art will recognize that the heat accumulator can be prefabricated and made, for example, out of stackable layers or blocks of refractory material.

In order to optimize the structure for ease of brushing out soot from the smoke collector, the tubes 3 communicate with a chamber having the shape of a funnel. Only one of the heat-exchange tubes 3 is disposed in the vertical or has a vertical axis at the center of the chamber in direct line with the smoke collector 4. Thus, all the soot falls into this one tube for the most part.

Finally, the apparatus may be provided with shut-off devices operated from outside the device for allowing to vary the cross section of the opening in the smoke and hot gases tubes 3.

A preferred embodiment of a fireplace and hood according to the invention is illustrated in FIGS. 4 through 7 insclusive. As shown, a closed fireplace 20 has sidewalls 21, 22 and a backwall 23. These walls are made of a refractory material and enclose the firebox 26 which has sidewalls 30, 31, and a backwall 32. The top of the firebox is formed by a solid structure 35 made according to the invention. A frontwall 36 has a door opening to the firebox 26.

The solid structure is preferably a monolithic structure of a refractory material that can absorb heat, store it, and susbsequently, radiate the stored heat when combustion in the firebox has closed as before described. Within the solide structure are disposed a plurality of internal hot gas flues 37, 38 grouped about a generally central collector flue 40 which is vertical. The others are not all vertical as shown.

The hot gas flues open at one side to a flat surface 41 defining the top of the firebox 26 and open at the other side into the central collector 40 in communication with an upstanding tubular member 45 in communication with the fireplace chimney, not shown. The inner flues are formed as before described. The flues may be tubes or passageways formed in the solid structure 35 when cast or poured. The flues are of sufficient cross section to allow cleaning of soot therefrom and of the smoke and hot gas collector 40.

The fireplace is provided with a number of convection tubes 50 laterally spaced internally of the sidewalls and backwall of the fireplace proximately to the firebox walls and heat cold air therein. The convection tubes 50 are open at a lower end communicating with spaces 52 about the base 54 of the firebox. Cold air entering into the convection tubes is first heated from heat from the firebox and as it moves upwardly the air is heated from the solid structure 35. The convection tubes are open at their top ends and in communication with a heat-recovery collector 60 in which the heated air is collected and from which it can be distributed, if desired, by a distribution circuit. It can be seen that the heated air rises in the convection tubes and a convection or circulatory air flow can be established.

Figure 5:
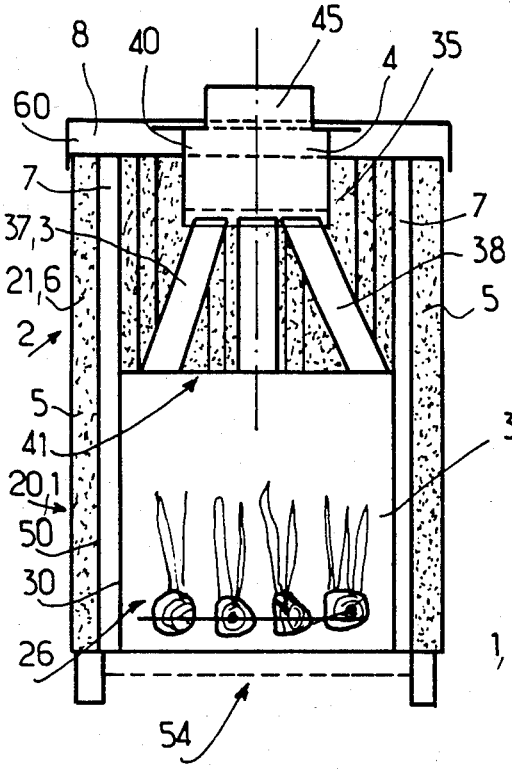
FIG. 5 is a vertical front cross section view of the fire place and hood shown in FIG. 4.
Figure 6:
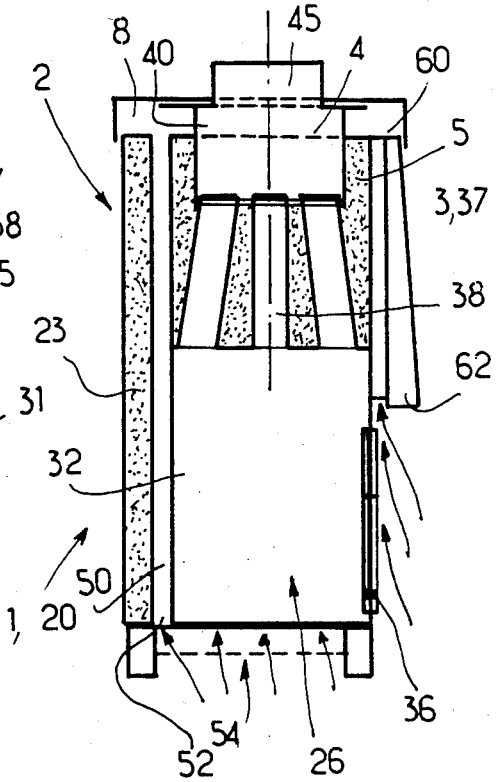
FIG. 6 is a vertical side cross section view of the fireplace shown in FIG. 1.
Figure 7:
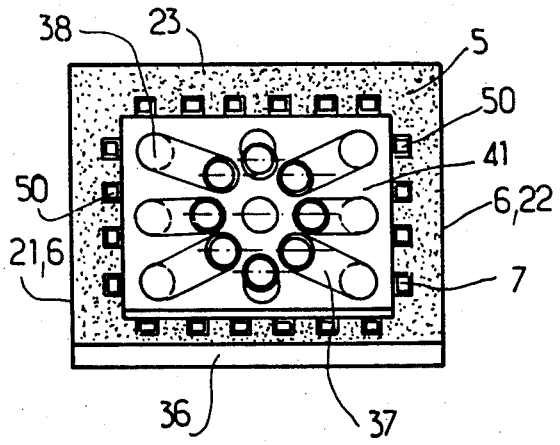
FIG. 7 is a horizontal cross section taken along section line 6—6 of FIG. 6.

Other convection tubes 50 are placed on the front of the firebox 26 above the front door as shown in FIGS. 5,6,7. Their lower openings are placed about the upper side of the frontdoor so as to receive the convection air warmed along the exterior face of the front door.

The so warmed air is conveyed through the above said front convection tubes 50 to the heat-covery collector 60 to be mixed their with the other convected air.

A slight slope deviation plate 62 is provided along the front convection tubes to obtain a better effect of gathering the air warmed along the front door.

As what may well be understood, heat is not only stored in the solid structure 35 during normal operation but also convected through the convection tubes 50 so as to produce immediat warmed air through the room and afterwards to render stored heat through the same convection tubes 50.

It is, of course, that the smoke collector can be made of a suitable material or formed in the refractory material of the solid structure 35 and the tubular member 45 is likewise formed of a material used for such members in fireplaces. The convection tubes likewise can be made of metal or ceramic and the like.

We claim:

1. A heat recovery and heat storage hood for use placed about a firebox of a fireplace comprising, a solid structure made of a massive mass of heat-absorbing material and having ducts capable of heating air therein and storing heat and radiating stored heat therefrom after combustion has terminated in the fire-box, the solid structure having vertical sidewalls positioned about vertical sidewalls and a backwall of the firebox and a large heat-storing volume of said heat-absorbing material defining a top for the firebox, means defining a heat-recovery collector in which hot air is collected disposed over the large heat-storing volume, said ducts being disposed in the sidewalls of the solid structure in communication with space externally of the firebox base and having open ends communicating with said heat-recovery collector, said ducts being disposed for receiving heat from the sidewalls and backwall of the firebox for heating air in the ducts for convection flow into the heat-recovery collector, the large heat-storing volume defining internally therein a hot gas collector chamber, said large volume of heat-absorbing material having a plurality of spaced hot gas inner flues open to a surface thereof defining the top of the firebox and in communication with the hot gas collector chamber for flow of hot gases and smoke upwardly from the firebox to enter into the hot gas collector chamber for heating the heat-absorbing material, a tubular member open to the hot gas collector chamber passing through said heat-recovery collector without communicating therewith for heating hot air in the heat-recovery collector by hot gases from combustion passing therethrough and extending therefrom for communication with a chimney of the fireplace, and the heat-recovery collector providing communication exteriorly thereof for heating with hot air collected therein.

2. A heat recovery and heat storage hood for use placed about a firebox of a fireplace according to claim 1, in which said ducts are in thermal contact with the sidewalls and backwall of the firebox.

3. A heat recovery and heat storage hood for use placed about a firebox of a fireplace according to claim 1, in which said inner flues include a vertically disposed central flue about which others of said inner flues are disposed inclined relative thereto and concentric therewith.

4. In a fireplace having a closed firebox, the improvement comprising a hood in the fireplace, said hood comprising a massive solid structure made of a heat-absorbing material capable of storing heat therein and radiating heat therefrom, said massive solid structure being disposed internally of the fireplace directly defining the top of the firebox, said solid structure defining internally thereof a hot gas collector chamber and having a plurality of passageways defining inner flues open to a surface defining the firebox top surface by the solid structure and providing communication to the hot gas collector chamber for receiving hot gases from combustion in the fireplace firebox, a tubular member defining a flue from the hot gas collector chamber for communication with a chimney of the fireplace, means defining a cold air entry adjacent a base of the firebox, means above the solid structure for defining a hot air collector at a top thereof, a plurality of laterally spaced convection ducts communicating with the cold air entry and the hot air collector disposed for receiving heat from the sidewalls and backwall of the firebox for heating air therein, said tubular member extending through said hot air collector without communicating therewith for heating hot air in said hot air collector by radiation, and said hot air collector providing communication for distribution of hot air therefrom.

* * * * *